US005722518A

United States Patent [19]

Aumasson

[11] Patent Number: 5,722,518

[45] Date of Patent: Mar. 3, 1998

[54] HANDLE FOR BAGGAGE

[75] Inventor: Michel Aumasson, Rueil Malmaison, France

[73] Assignee: Delsey, France

[21] Appl. No.: 609,636

[22] Filed: Mar. 1, 1996

[30] Foreign Application Priority Data

Mar. 3, 1995 [FR] France ..... 95 02471

[51] Int. Cl.[6] ..... A45C 5/14; A45C 13/26

[52] U.S. Cl. ..... 190/115; 190/18 A; 190/39

[58] Field of Search ..... 190/18 A, 39, 190/115–117, 101; 16/115, 112 R; 150/108; 280/37

[56] References Cited

U.S. PATENT DOCUMENTS

| | | | |
|---|---|---|---|
| 1,979,978 | 11/1934 | Martin | 190/115 |
| 2,375,338 | 5/1945 | Alexander | 190/18 A X |
| 2,769,475 | 11/1956 | Fisher | 190/115 |
| 2,845,155 | 7/1958 | Sneyd-Kynnersley | 190/115 X |
| 3,128,855 | 4/1964 | Hoffman et al. | 190/115 |
| 3,198,300 | 8/1965 | Tuttle | 16/115 |
| 3,982,613 | 9/1976 | Wood | 190/18 A X |
| 4,508,202 | 4/1985 | Siegert et al. | 190/115 |
| 5,027,874 | 7/1991 | Gazzola | 150/108 |
| 5,147,019 | 9/1992 | Vanhooreweder et al. | 190/115 X |
| 5,294,029 | 3/1994 | Shimura et al. | 150/108 X |
| 5,533,600 | 7/1996 | Van Himbeeck et al. | 190/115 X |
| 5,555,960 | 9/1996 | Bartsch | 190/115 |

FOREIGN PATENT DOCUMENTS

| | | | |
|---|---|---|---|
| 0 298 947 A3 | 1/1989 | European Pat. Off. . | |
| 2 139 578 | 1/1973 | France . | |
| 2608388 | 6/1988 | France | 150/108 |
| 2645416 | 10/1990 | France | 150/108 |
| 94 06 969 | 10/1994 | Germany . | |
| 2238955 | 6/1991 | United Kingdom | 150/108 |
| 2276148 | 9/1994 | United Kingdom | 190/18 A |
| 9215219 | 9/1992 | WIPO | 190/18 A |
| 9324029 | 12/1993 | WIPO | 190/115 |

OTHER PUBLICATIONS

European Search Report–EPO Appln No. 96 40 0427.9 Jun. 20, 1996.

*Primary Examiner*—Sue A. Weaver
*Attorney, Agent, or Firm*—Finnegan, Henderson, Farabow, Garrett & Dunner, L.L.P.

[57] ABSTRACT

A baggage handle for a wheeled luggage case is positioned at a curved corner of the case and is attached by a retractable strap allowing the handle to be extendable from the case and, when not extended, the handle seats against the curved corner of the case.

5 Claims, 2 Drawing Sheets

HANDLE FOR BAGGAGE

BACKGROUND OF THE INVENTION

1. Field of the Invention

The present invention relates in a general way to baggage and more particularly to a baggage handle.

1. Description of the Related Art

Items of baggage are more and more often fitted with wheels on their underside to make it easier to move the baggage around. A person using such an item of wheeled baggage can thus pull it along behind himself or herself instead of carrying it.

Such items of baggage comprise a handle on an end edge. The mounting of this handle usually allows it to be rotated about a pivot pin supported by the baggage in such a way that the handle is positioned, when at rest, against said end edge of the baggage and is moved into a "working" position in which it enables the baggage to be pulled along raised partly off the ground.

Handles attached by the end of a strap fixed to the baggage have also been proposed. This strap is positioned when at rest in a housing on the baggage while the handle is positioned against the outer wall of this baggage. When the user wishes to pull the baggage, he or she grasps the handle in the hand and pulls. Initially the strap comes out of its housing, and then, when the strap is fully out, the baggage moves. When the user has finished pulling the baggage, the strap is returned to the rest position inside the housing by a return means. This action of returning the strap also returns the handle to its rest position.

Documents U.S. Pat. No. 4,508,202 and EP 0,298,947 describe such handles attached by the end of a strap fixed to the baggage.

It has been found that this type of device gives satisfaction as regards moving the baggage, but poses a problem when the handle is being returned to its rest position, as the latter does not always position itself properly against the outer wall of the baggage.

In order to overcome this problem, the invention provides a baggage handle on the corner between the top edge of the baggage and the end edge of the baggage and improves this arrangement so that the handle is positioned approximately in the central plane of the baggage.

SUMMARY OF THE INVENTION

The subject of the invention is a baggage handle, especially for wheeled baggage, positioned on the corner between the top edge of the baggage and the end edge of the baggage and connected to the end edge of the baggage by a first length of a strap, the end of which is fixed in a housing on the baggage by means of intermediate return means, characterized in that the handle is connected to the top edge of the baggage by a second length of the strap, in that the two lengths of the strap pass into said baggage at two spaced-apart points, and in that these two spaced-apart points are situated facing the positions occupied by the points of attachment of the lengths of strap at the ends of the handle when said handle is in its position of rest against the wall of the baggage, that is when the handle is flat against the baggage.

The handle according to the invention is also noteworthy in that:

said lengths are formed by two portions of a continuous looped strap, said lengths of the strap pass into said baggage at two spaced-apart points, it consists of two shells fixed together on a joining plane, one of the shells has two slots through which the lengths of the strap pass into the body of the handle, a passageway is formed in the interior of the handle to guide the strap, it is situated on the comer between the top edge of the baggage and its end edge and has a generally straight portion and a rounded portion.

The invention also relates to baggage of the type comprising wheels, characterized in that it comprises a handle according to the invention.

BRIEF DESCRIPTION OF THE DRAWINGS

The invention will be understood more clearly on examining the following description, given by way of a non-restrictive example with reference to the accompanying drawings in which.

DESCRIPTION OF THE PREFERRED EMBODIMENT

Figure 1:
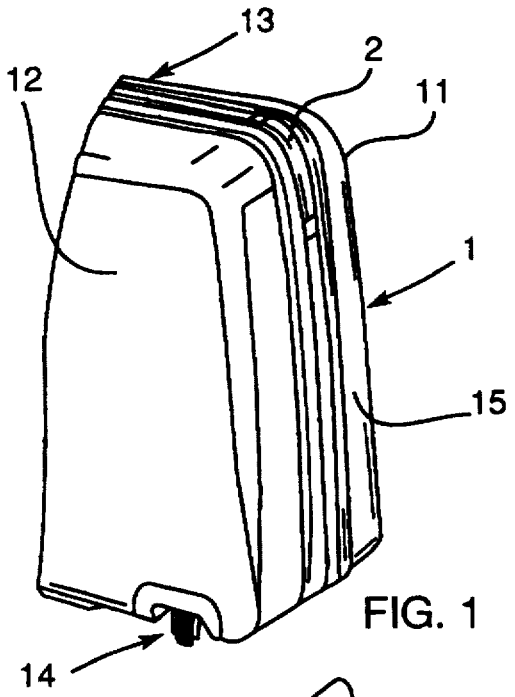
FIG. 1 is a partial perspective view on an item of baggage fitted with a handle according to the invention, at rest.

The item of baggage 1 illustrated in the drawing is of a type often used, comprising two shells 11 and 12 meeting around a peripheral frame 13. In a manner known per se, hinge means and locking means, not shown in the drawing, are provided around the peripheral frame 13. A handle, also not shown in the drawing, is usually positioned in the center of the top edge of the baggage to enable it to be carried.

The baggage 1 is fitted with wheels 14 on which the user can pull it along.

The handle 2 by which the user pulls the suitcase is usually positioned on an end edge 15 of the item of baggage at a point on this edge close to the top edge.

The handle 2 is positioned on the comer between the top edge of the baggage and its end edge 15.

Figure 2:
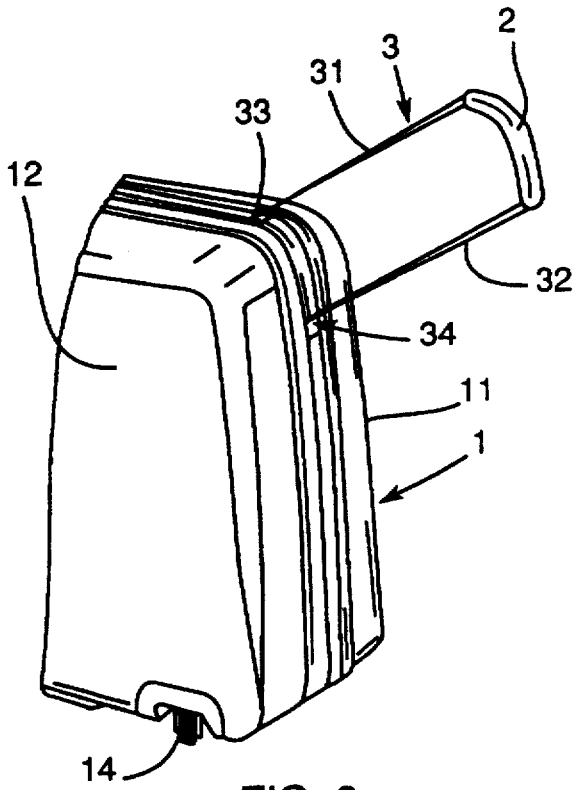
FIG. 2 is a partial perspective view of the item of baggage shown in FIG. 1 with the handle in the working position.

According to the invention and as visible in FIG. 2, each end of the handle 2 is connected to the baggage 1 by a length 31 or 32 of a strap, each of which passes into said baggage at a point situated facing the position occupied by the point of attachment of the length of strap to the end of the handle, when the handle is placed flat in its rest position against the wall of the baggage.

In a manner known per se and not illustrated in the drawing, the strap means 3 are arranged in a housing formed on the wall of the baggage in the rest position illustrated in FIG. 1.

The ends of the lengths 31 and 32 of the strap are fixed inside this housing by means of intermediate return means.

Such an arrangement is highly advantageous because it means that both ends of the handle 2 are subject to the return force and it allows the handle to be positioned properly on the wall of the baggage when the pulling action ceases.

The lengths 31 and 32 of the strap preferably pass into said housing at two spaced-apart points 33 and 34: this improves the manner in which they return into the housing.

These points 33 and 34 are situated facing the positions occupied by the points of attachment of the lengths of strap to the ends of the handle when said handle is in its position of rest against the wall of the baggage.

This arrangement ensures that both ends of the handle are laid flat against the baggage in the rest position by the return means.

Figure 3:
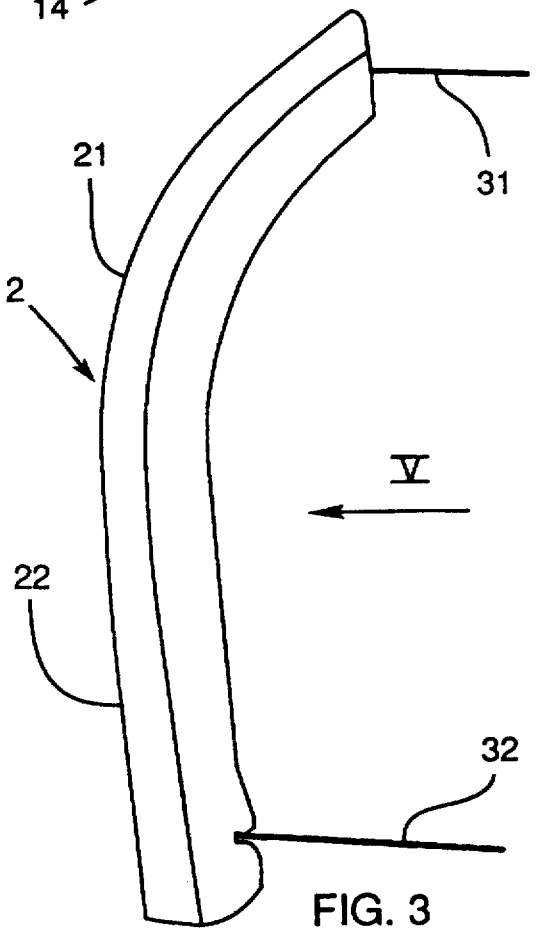
FIG. 3 is a side view of the handle according to the invention.
Figure 4:
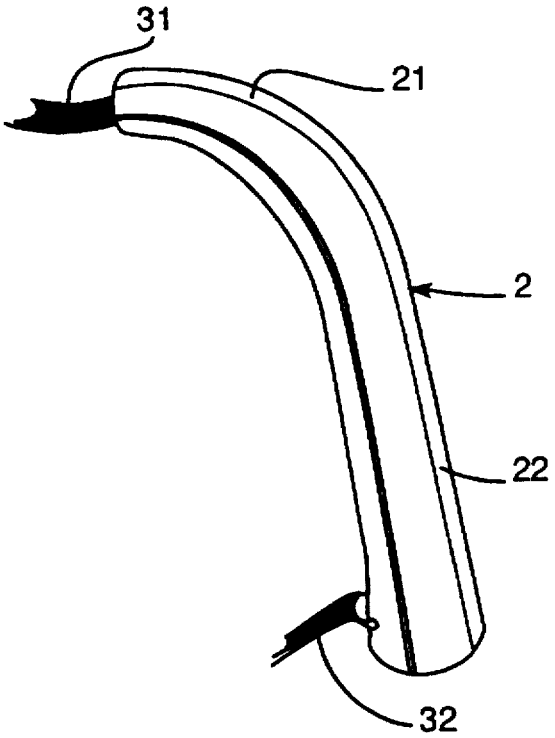
FIG. 4 is a perspective view from the side of the handle according to the invention.

In order to give an attractive overall appearance to the baggage fitted with the handle according to the invention on the corner between the top edge of the baggage and its end edge, the handle 2 comprises, as can be seen in FIGS. 3 and 4, a generally straight portion 22 and a rounded portion 21.

This shape and the pleasing curve given to the handle enable it to be grasped securely in the hand.

Figure 5:
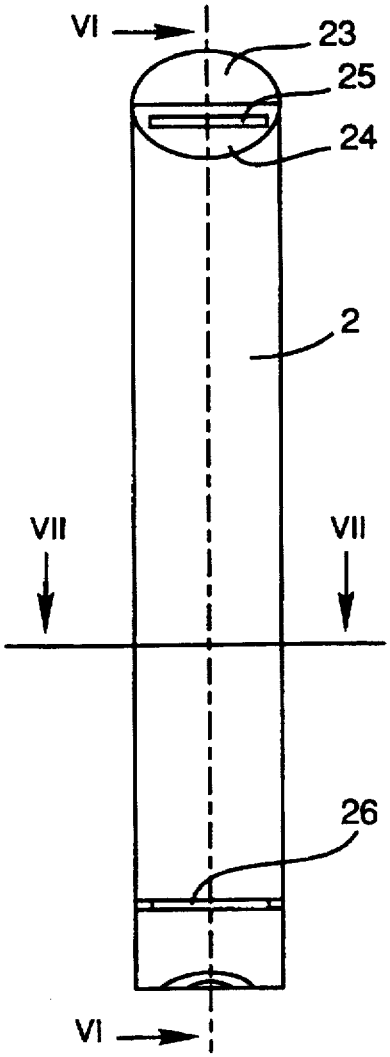
FIG. 5 is a view of the handle seen in the direction of the arrow marked V in FIG. 3.
Figure 6:
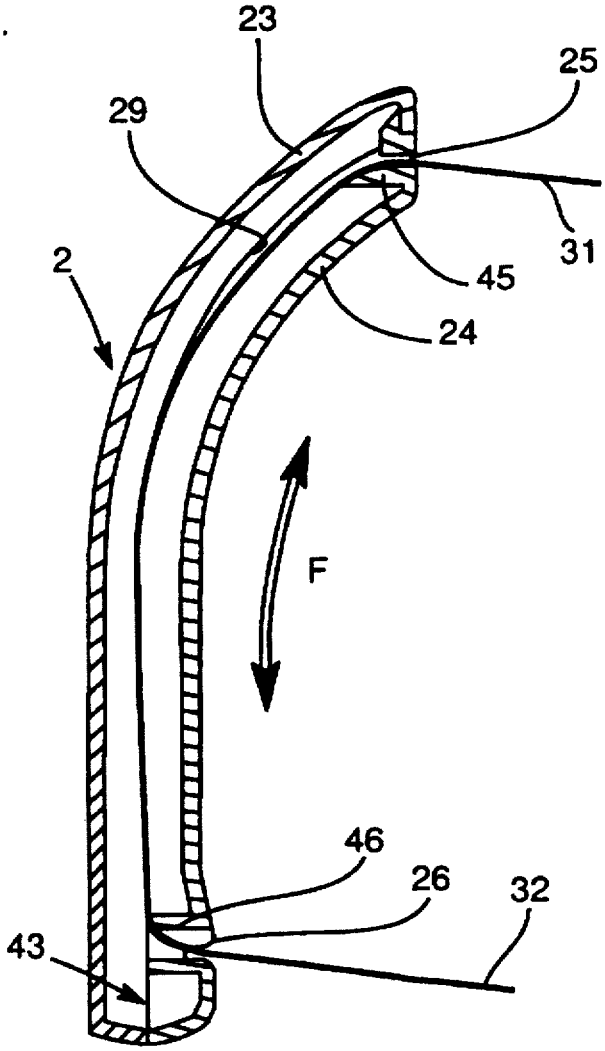
FIG. 6 is a sectional view on the plane marked VI—VI in FIG. 5.
Figure 7:
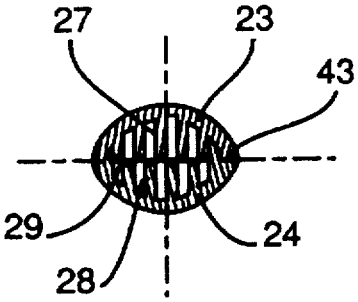
FIG. 7 is a sectional view on the plane marked VII—VII in FIG. 5.

FIGS. 5 through 7 illustrate in detail the nonrestrictive embodiment of the handle illustrated in the drawing.

This handle 2 consists of two shells 23 and 24 fixed together on a joining plane 43. These two shells can be fixed together by any known method, adhesive bonding, ultrasonic: welding, etc.

In the example illustrated, the shell 24, which is on the inside of the bend of the handle, has two slots 25 and 26 through which the lengths 31 and 32 of the strap pass into the body of the handle.

Said lengths 31 and 32 can be fixed inside the interior of the body of the handle after having been passed through said slots 25 and 26.

Preferably, and as illustrated in the drawing, said lengths 31 and 32 are formed by two portions of a continuous looped strap 3.

The slots are the points of attachment of the strap to the ends of the handle, said point of attachment not being fixed.

Said strap 3 then runs through the interior of the handle from one slot to the other 25, 26.

With this arrangement the handle 2 has no fixed position on the strap means connecting it to the baggage and can be moved along said strap, as illustrated by the double arrow F in FIG. 6, and thus occupy a position suitable for the angle at which it is being pulled.

As will readily be understood, a tall user and a short user will not pull the handle in the same way, so said handle will have to be closer to point 33 in one case and closer to point 34 in the other case. The ability thus given to the handle to move along the looped strap 3 therefore means that the position of said handle and its distance from the points 33 and 34 can be adapted to the user.

The handle 2 is returned to a middle position when taken back to its rest position by the retrieval of the strap into the housing.

As a result of the ability of the handle to move along the strap, the device can be simplified, as it requires only a single strap-return means arranged on one of its ends. When the handle is being returned to the rest position, its end nearest the point where the strap is connected to the return means is brought back against the wall of the baggage, after which the strap runs through the handle and brings the other end of the handle down onto the wall of the baggage.

A passageway 29 is formed in the interior of the handle 2 illustrated in the drawing, in order to guide the strap 3.

FIG. 7 shows how this passageway 29 is formed by walls 27 and 28 running longitudinally along each shell 23 and 24.

Other arrangements can of course be employed to form such a passageway.

As can be seen in FIG. 6, the shell 24 includes rounded sections 45 and 46 in the continuation of the walls of the slots 25 and 26 against which the strap 3 presses: the surface over which the strap runs is thus rounded so that it is less likely to become worn by being run back and forth through the handle.

The present invention is not limited to the illustrative embodiment shown in the drawing, and many modifications can be made thereto by those skilled in the art.

For example, it is possible not to have the strap run through the interior of the volume of the handle but to provide bridges on the wall of said handle to secure said handle on the strap while still allowing for relative movement.

Similarly, the broad strap illustrated in FIG. 4 can be replaced with one or more cords.

I claim:

1. A wheeled case, comprising:

a housing having a top edge and an end edge joined at a curved corner;

a handle having first and second ends and a curved portion therebetween to seat against the curved corner;

a strap disposed through the handle slidably connecting the first end of the handle to the top edge and the second end to the end edge; and a retracting means connected to at least one end of the strap allowing the handle to retractably extend from the housing.

2. The wheeled case as recited in claim 1, wherein the handle is formed of two handle shells.

3. The wheeled case as recited in claim 2, wherein the handle has two slots and the strap passes through each of the slots into the handle.

4. The wheeled case as recited in claim 1, wherein the handle defines a strap passageway to guide the strap through the handle.

5. The wheeled case as recited in claim 1, wherein the handle has a generally straight portion extending from the curved portion.

* * * * *